US007632199B2

(12) United States Patent
Kikos

(10) Patent No.: US 7,632,199 B2
(45) Date of Patent: Dec. 15, 2009

(54) HUNTING ARROW TRACKING SYSTEM

(76) Inventor: Joseph L. Kikos, 7571 State Park, Centerline, MI (US) 48015

( * ) Notice: Subject to any disclaimer, the term of this patent is extended or adjusted under 35 U.S.C. 154(b) by 366 days.

(21) Appl. No.: 11/589,566

(22) Filed: Oct. 30, 2006

(65) Prior Publication Data

US 2007/0105668 A1 May 10, 2007

Related U.S. Application Data

(60) Provisional application No. 60/731,315, filed on Oct. 28, 2005.

(51) Int. Cl.
*F42B 6/04* (2006.01)

(52) U.S. Cl. ..... 473/578

(58) Field of Classification Search ..... 473/578
See application file for complete search history.

(56) References Cited

U.S. PATENT DOCUMENTS 4,421,319 A * 12/1983 Murphy ..... 473/570
4,675,683 A * 6/1987 Robinson et al. ..... 342/386
4,885,800 A * 12/1989 Ragle ..... 455/98
4,976,442 A * 12/1990 Treadway ..... 473/570
5,024,447 A * 6/1991 Jude ..... 473/570
5,157,405 A * 10/1992 Wycoff et al. ..... 342/386
6,856,250 B2 * 2/2005 Hilliard ..... 340/573.2
2002/0091023 A1 * 7/2002 Porter ..... 473/578

* cited by examiner

*Primary Examiner*—John Ricci
(74) *Attorney, Agent, or Firm*—The Weintraub Group, PLC

(57) ABSTRACT

A locating and tracking system for tracking or locating an object of interest, such as a hunting arrow or wounded animal, uses a transmitter in the arrow and a transceiver in combination with GPS positioning system for monitoring and relaying radio frequency signals from a battery powered microchip carried in the hunting arrow to provide a hunter with information as to the location of the arrow and/or to track the animal into which the arrow has been embedded during hunting.

13 Claims, 2 Drawing Sheets

HUNTING ARROW TRACKING SYSTEM

CROSS-REFERENCE TO RELATED APPLICATIONS

This application is a completion application of co-pending U.S. Provisional Patent Application Ser. No. 60/731,315, filed Oct. 28, 2005, the entire disclosure of which is hereby incorporated by reference.

BACKGROUND OF THE INVENTION

1. Field of the Invention

The present invention relates generally to a locating and tracking system for tracking or locating an object of interest, such as a hunting arrow or wounded animal, and more particularly, to a hunting arrow locating system using a transmitter in the arrow and a transceiver in combination with GPS positioning system for monitoring and relaying radio frequency signals from a battery powered microchip carried in the hunting arrow to provide a hunter with information as to the location of the arrow and/or to track the animal into which the arrow has been embedded during hunting.

2. Description of Prior Art

Hunting with a bow and arrow is a popular sport. After an arrow has been shot from the bow, it is often difficult to locate, whether it hits its target or not. If the arrow misses the target, it often disappears in the brush. If the arrow hits a target animal, such as a deer, the animal is often able to run quite a distance before it collapses as it succumbs to its wound. In such a case, it is often difficult to locate the wounded animal. In the first case, it would be desirable to locate and recover the missing arrow. In the second case, it would be desirable to locate the missing game as well as recover the missing arrow.

A number of U.S. patents address the problem of locating a missing arrow and/or wounded animal. By way of example, Hilliard U.S. Pat. No. 6,856,250, incorporated herein by reference, provides an arrow with a radio transmitter assembly and a barb arrangement. In Hilliard, the barbs engage with the animal and the radio transmitter is in the form of a transponder that detaches from the arrow upon impact with the animal.

The references cited in the above-noted U.S. Patent illustrates that there are many approaches, systems, and arrangements for solving specific problems associated with locating objects, such as an arrow, or a wounded animal with such arrow.

The hunter is always desirous of improvements in the art and it is to that need that the present invention is drawn.

SUMMARY OF THE INVENTION

The present invention is directed to a trackable hunting arrow, comprising an elongated shaft having forward and rearward ends, an arrowhead attached to said forward end, a nock housing of electrically nonconductive material, said nock housing having forward and rearward ends and an interior chamber opening on one end of the housing, a battery in said chamber, a radio transmitting apparatus in said chamber for transmitting a radio signal to a complementary receiver, said transmitter in electrical circuit relation with said battery, first means for closing the rearward end of said nock housing, second means for closing the forward end of said nock housing and removably attaching the nock housing to the rearward end of said shaft, said first and second means cooperating to captivate said battery and radio transmitting apparatus in said chamber, one said closing means enabling the user to selectively secure and remove the radio transmitter and battery into operable relation when ready for use, and an attachment device for impaling itself into the animal and attaching the arrow with battery and transmitter into said animal until located.

Preferably, according to an aspect of this embodiment, the first means comprises a closure wall operating to close the rearward end of the nock housing, a nock is attached to the closure wall, and the second means comprises operable threadable interengagement between an externally threaded stem extending rearwardly from the arrow and thread on the chamber wall, threadable engagement therebetween operating to close, as well as attach, the forward end of the nock housing to the rearward end of the arrow shaft.

According to another aspect of the invention, the second means is as described, but the first means comprises an externally threaded stem from the nock being adapted to threadably engage with internal thread on the chamber wall.

According to this invention, the attachment device comprises a flat an annular mounting plate captivated between the forward end of the nock housing and the rearward end of the arrow, and at least one resilient impaling barb extending longitudinally forward of the housing, the impaling barb being spaced radially outwardly from the central axis of the shaft and adapted to flex or spread outwardly to prevent the arrow from passing through the animal.

Further, the arrow includes means for biasing the battery into electrical circuit relation with said battery. Preferably, the means for biasing comprises a coil spring, wherein one end of the spring engages the battery and the other end engages a chamber closure.

Further and according to this embodiment, the transmitting apparatus is a microchip, such as embodied in a transponder, or radio transmitter-receiver device, that transmits identifiable signals automatically when the proper interrogation is received from a transceiver remote thereto.

Alternatively, the transmitter is a pulse repeater that receives pulses from the transceiver circuit and transmits corresponding pulses at another frequency, waveshape into the transceiver circuit.

The present invention is also directed to a tracking system for detecting the location of an arrow or animal into which the arrow has been impaled relative to a positional satellite, the system comprising:

an arrow, said arrow including a shaft having forward and rearward ends, an arrowhead at the forward end, a nock housing of electrically conductive material and having a chamber extending between the opposite ends of the housing, a transmitting apparatus assembled within the chamber, said transmitting apparatus including a receiver chip and provided with a code adapted to be read by said satellite wherein to transmit positional data regarding the real time latitude and longitude location of the location of the arrow, means for selectively removing and securing the nock housing to the rearward end of the arrow, and barb means for attaching and impaling the arrow, at least in part, into the animal, said barb means being captivated to the rearward end portion of the shaft by the nock housing, and a transceiver responsive to positional data transmitted to the positional satellite from the transmitter, said receiver including a display screen for displaying information regarding the location of the receiver chip.

The present invention will be more clearly understood with reference to the accompanying drawings and to the following Detailed Description, in which like reference numerals refer to like parts and where:

DETAILED DESCRIPTION OF A PREFERRED EMBODIMENT

Figure 1:
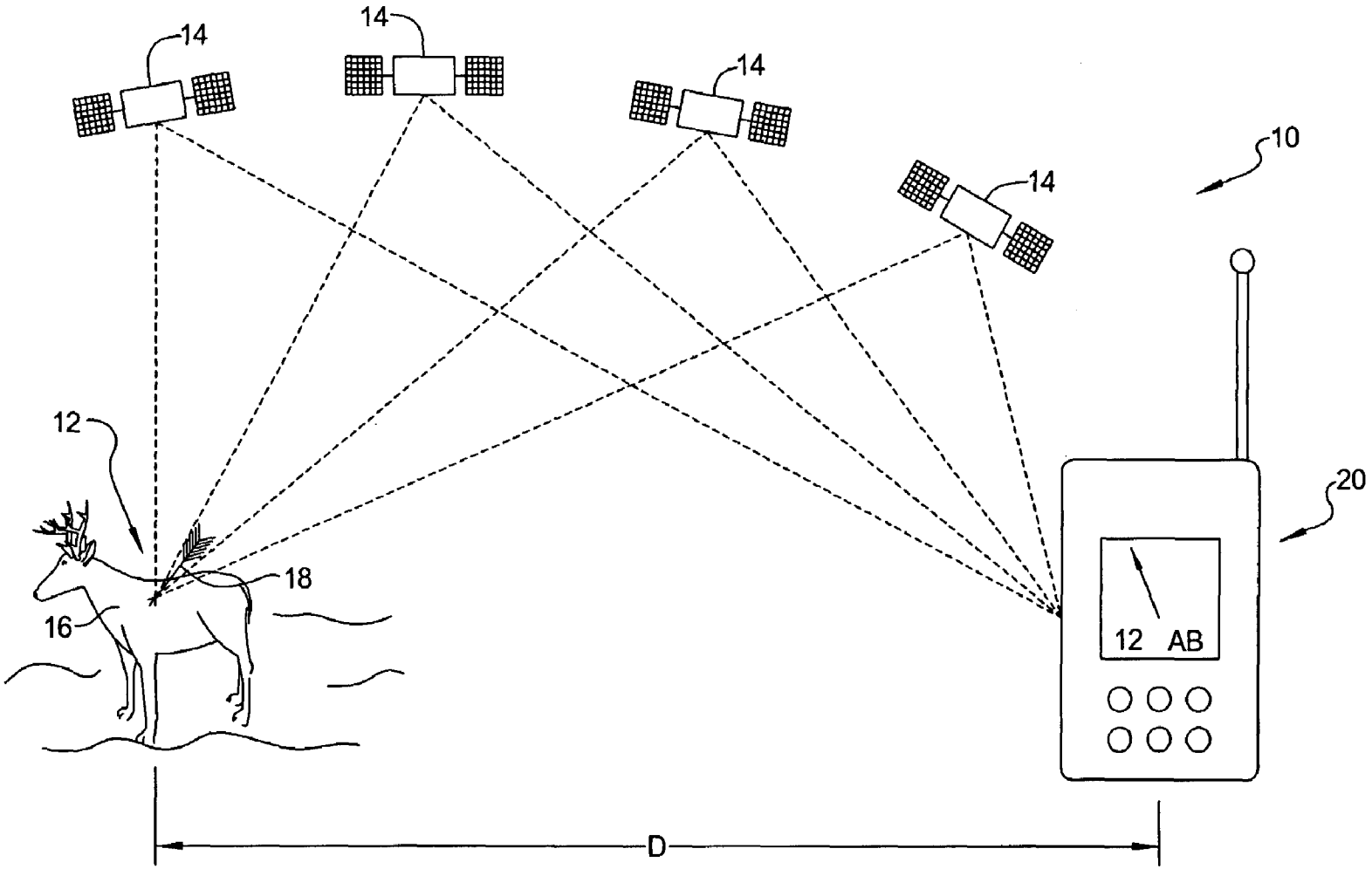
FIG. 1 illustrates a tracking system for detecting the location of a trackable hunting arrow or animal wounded by the arrow, according to the present invention.

Turning now to the drawings, FIG. 1 illustrates a tracking system 10 for detecting the location of a hunting arrow 12 relative to at least one of an array of positional satellites 14. In particular, the tracking system 10 has application in determining the location of the arrow 12, either when lost or when impaled into an animal 16, and the animal, although wounded, has run off and needs to be tracked.

The tracking system 10, described in greater detail herein below, includes the hunting arrow 12, provided with a transmitting apparatus 18, global positioning system ("GPS") satellites 14, and a transceiver 20.

Figure 2:
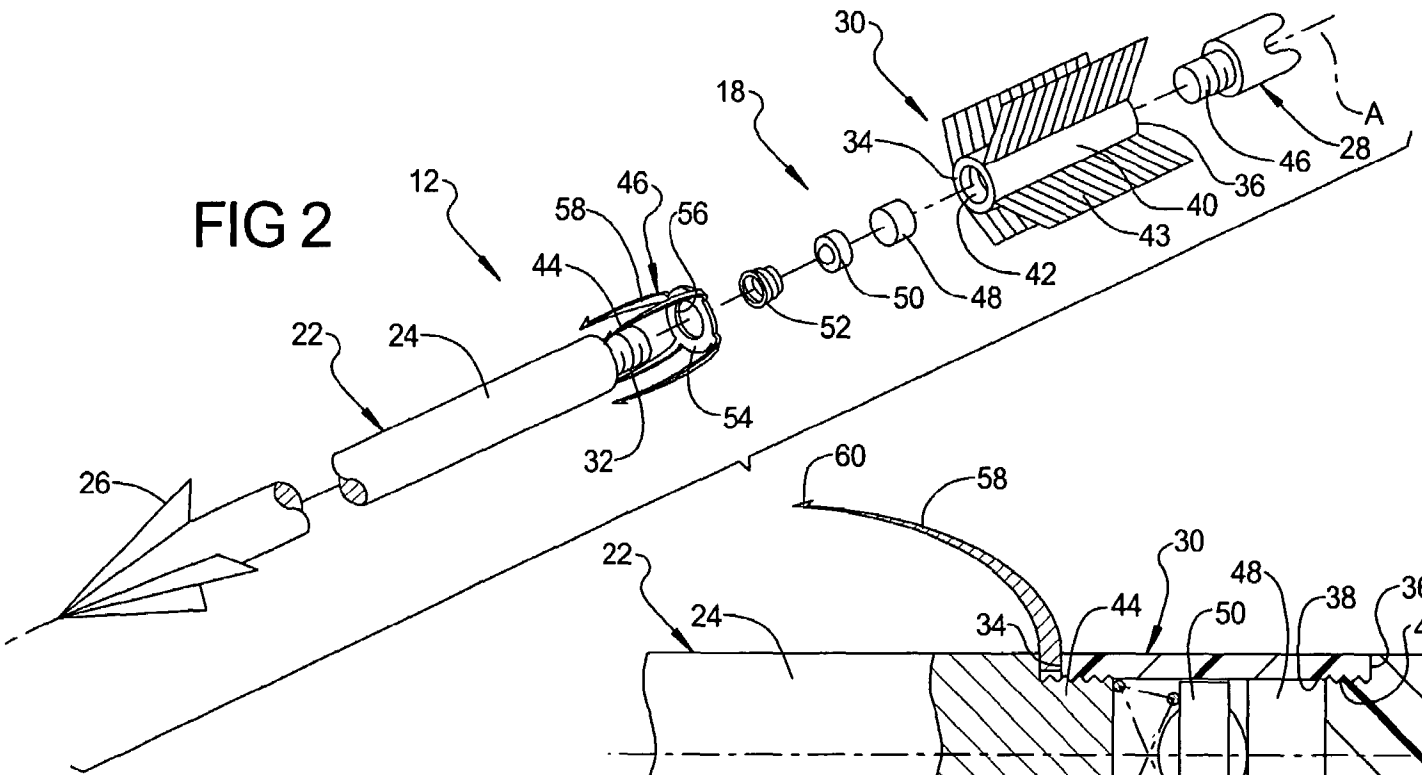
FIG. 2 is an exploded assembly view of the trackable hunting arrow according to the present invention.

As shown in FIG. 2, the arrow 12 comprises an axially elongated shaft 22 having a cylindrical outer surface 24 aligned on a central longitudinal axis "A", an arrowhead 26 at the forward end of the shaft, and a nock 28 at the rearward and of the arrow for positioning the arrow relative to an archer's bow string. (not shown). The shaft 22 is comprised of metal, such as aluminum, fiber glass, carbon graphite, carbon and aluminum carbon, plastic, wood, or other combinations of materials. The arrowhead 26 is conventional and will not be described further.

Figure 3:
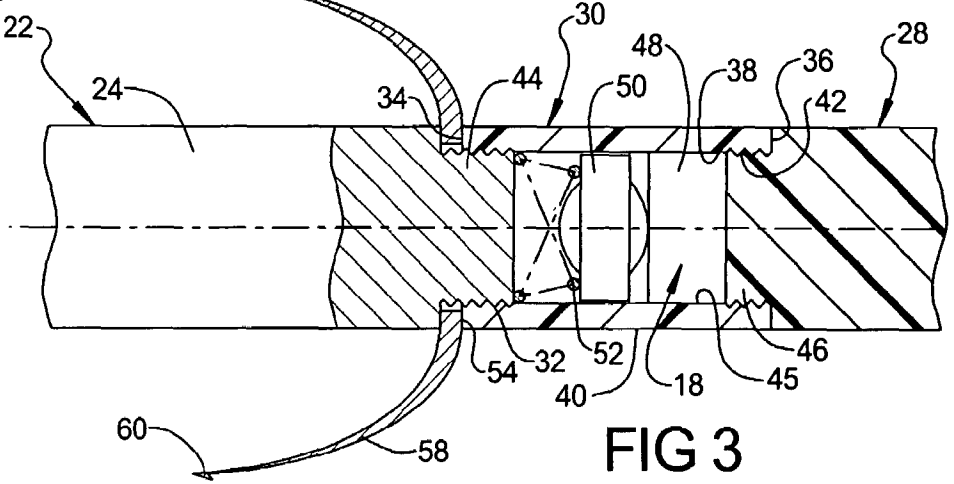
FIG. 3 is a section view of the rearward end portion of the hunting arrow of FIG. 2, when assembled, and details of a nock housing for housing a tracking transmitter, according to the invention.

According to this invention, a generally cylindrical nock housing 30 is removably secured to the rearward end 32 of the shaft 22. As shown in FIG. 2, the nock housing 30 is open at the forward and rearward ends 34 and 36 and a central cylindrical chamber 38 extends coaxially between the ends. The housing 30 includes a cylindrical outer surface 40 and flecking or feathers 43 extend radially outwardly from the outer surface 40. FIG. 3 shows the nock housing 30 secured to the rearward end of the shaft 22 but without the feathers 43 to improve clarity of the drawing.

While the manner of securement of the nock housing to the shaft is not critical, once secured, the nock housing 30 and the shaft 22 are preferably generally coaxially aligned with the central longitudinal axis "A" and the outer surfaces 24 and 40, respectively, of the shaft 22 and nock housing 30 cooperate to form a smooth continuous surface so as to provide an aerodynamic shape.

Many arrangements for securing the nock housing 30 to the shaft 22 are suitable. In the embodiment shown in FIGS. 2 and 3, the rearward end 32 of the shaft 22 includes an externally threaded stem 44 that is adapted to be inserted into the chamber 38 of the nock housing 30 and threadably engage with complementary thread 42 formed on the internal cylindrical wall 45 of the chamber. As will be appreciated in the description that follows, removability of the nock housing 30 from the arrow shaft 22 will enable the user to access the chamber 38 as well as in securing animal impaling apparatus 46 to the rearward end of the arrow.

Further, the nock 28 may function as a closure for closing the rearward end 36 of the nock housing 30. As illustrated, an externally threaded stem 46 extends from the nock 28 and is adapted to be inserted into the chamber 38 of the nock housing 30 and threadably engage with complementary thread 42 formed on the internal cylindrical wall 45 of the chamber. As such, access to the chamber 38 is enabled by removal of the nock 28 from the nock housing 30.

In some applications, the nock 28 and nock housing 30 may be formed as a one piece unit, with the outer surfaces of each forming a smooth outer cylindrical surface that is coaxial with the central axis of the arrow shaft 22.

Importantly, however, in use and when secured to the shaft, the nock housing 30 does not detach from the arrow 12 following the impaling of the arrow into an animal.

According to this invention, the transmitting apparatus 18 is sized to fit within the chamber 38 and includes a microchip 48 and a battery 50 in electrical circuit relationship with the microchip 48 for providing power thereto. For electrical transmission reasons, the nock housing 30 is comprised of an electrically non-conductive material.

Preferably, the nock housing 30 is comprised of a lightweight polymeric material, such as nylon. Further, such material would also preferably be transparent to enable the user to see that the components have been properly placed within the chamber and the arrow 12 is ready for use.

The transmitter assembly 18 also may include a resilient coil spring 52 with opposite axial ends thereof positioned so as to press against the battery 50 and the stem 44 and bias the battery against the microchip 48. The coil spring 52 will ensure that power is supplied to the microchip 50 once the transmitter assembly 18 is received in the chamber 38.

The impaling apparatus 46 comprises a flat annular plate 54 provided with a central opening 56 and several animal engaging talons or barbs 58. The central opening 56 is sized to fit about the stem 44 and the annular plate 54 is adapted to be snugly captivated (i.e., sandwiched) between the rearward end face of the shaft 22, from which the stem 44 extends, and the forward end face 34 of the nock housing 30.

The talons 58 are cantilevered about the outer circumference of the plate and extend axially forwardly towards the arrowhead. The forward end portion of each talon is radially outwardly from the outer periphery of the shaft and is configured to define an animal engaging or impaling barb 60.

Preferably, the impaling apparatus 46 includes four talons 58 arranged at 90° about the plate and generally perpendicular thereto. In some applications, the number may be greater or less than four.

In use, when a hunting arrow hits an animal, the velocity of the arrow may result in the arrow passing through the animal. According to this invention, the talons 58 operate to engage the animal, and the flex outwardly and away from the arrow. As such, the talons 58 and barbs 60 operate to be impaled into the animal and prevent the arrow from passing through the animal. As such, the transmitter 18 remains affixed to the animal.

The transmitter assembly 18 uses the triangulation system provided by global positioning system ("GPS") satellites 14. The microchip includes a GPS unit for determining the location coordinates of the arrow and circuitry that facilitate wireless communication with a remote source (i.e., the receiver) Preferably, the GPS unit and circuitry are disposed on a service platform, e.g., a circuit board or other substrate and as referred to herein as the microchip. The microchip is provided with a code adapted to be read by the GPS satellite system wherein to transmit positional data regarding the real time latitude and longitude location of the location of the arrow, The hunter carries a hand held transceiver 20 to record his position prior to beginning signal transmission to locate the tracking transmitter 18 previously embedded into the animal.

Preferably, the transceiver, which is a GPS hand held locator, is enabled to receive and display video and text data, and capable of triangulating coordinates from locations signals. Such transceivers are well known and commercially available.

Upon sending and receiving an initial signal, the hunter would use the GPS reading to establish a search zone where the target is most likely to be found. This zone could be established from a combination of signal direction (such as by a transceiver unit) and distance (e.g., such as indicated by a known range of detection or an indicator of signal strength). Upon conducting the search, the hunter could record his movement using the output from the GPS unit to thereby conduct a systematic search for the target (e.g., the arrow).

The distance "D" within which a target arrow, or animal impaled by same, can be tracked or located depends on the strength of the receiver. Preferably, for a lightweight system, such ranges would be between 500 and preferably about 2,000 feet.

The transmitter 18, once loaded into the chamber, is in an "active" state and sends signals. The length of time for such signal transmitting depends on the battery. Preferably, the battery would have a high power, be light in weight, be rechargeable, and have a long transmitting life. The transmitting life would preferably be 5 to 6 days of continuous transmitting, or running time. Exemplary would be commercially available nickel-cadmium (NiCd), lithium ion, and neodymium batteries. Additionally, less expensive AA batteries may be used.

Desirably, the tracking system herein is usable with almost all hunting arrows. Further, the transmitter will normally be completely intact after use, and thus may be reused over and over again, subject to battery replacement.

Further and according to this embodiment, the transmitting apparatus may comprise a transponder, or radio transmitter-receiver device, that transmits identifiable signals automatically when the proper interrogation is received from a transceiver remote thereto.

Alternatively, the transmitter may comprise a pulse repeater that receives pulses from the transceiver circuit and transmits corresponding pulses at another frequency, wave shape into the transceiver circuit.

Reference to the above-incorporated Hilliard reference discloses conventional arrangements of active and passive transponders as well as other conventional wireless RF transmitting arrangements, which may be used in the apparatus herein.

It will be appreciated that, although specific embodiments of the invention have been described herein for purposes of illustration, various modifications may be made within the spirit and scope of the invention. An equivalent structure for those shown herein falls within the invention and the claims.

The invention claimed is:

1. A trackable hunting arrow, comprising an elongated shaft having forward and rearward ends, an arrowhead attached to said forward end, a nock housing of electrically nonconductive material, said nock housing having forward and rearward ends and an interior chamber opening on one end of the housing, said nock housing being located proximal to the rearward end of the shaft, a battery in said chamber, a radio transmitting apparatus in said chamber for transmitting a radio signal to a complementary receiver, said transmitter in electrical circuit relation with said battery, first means for closing the rearward end of said nock housing, second means for closing the forward end of said nock housing and removably attaching the nock housing to the rearward end of said shaft, said first and second means cooperating to captivate said battery and radio transmitting apparatus in said chamber, one said closing means enabling the user to selectively secure and remove the radio transmitter and battery into operable relation when ready for use, and an attachment device for impaling itself into the animal and attaching the arrow with battery and transmitter into said animal until located, whereby the attachment device is secured fastened to the arrow and prevents the arrow from passing through the animal.

2. The trackable hunting arrow of claim 1, wherein said first means comprises a closure wall operating to close the rearward end of the nock housing, a nock is attached to the closure wall, and said second means comprises operable threadable interengagement between an externally threaded stem extending rearwardly from the arrow and thread on the chamber wall, threadable engagement therebetween operating to close, as well as attach, the forward end of the nock housing to the rearward end of the arrow shaft.

3. The trackable hunting arrow of claim 2, wherein said first means comprises an externally threaded stem from the nock being adapted to threadably engage with internal thread on the chamber wall.

4. The trackable hunting arrow of claim 1, wherein said attachment device comprises a flat annular mounting plate captivated between the forward end of the nock housing and the rearward end of the arrow, and a plurality of resilient impaling barbs extending longitudinally forward of the housing, the impaling barbs being spaced radially outwardly from the central axis of the shaft and adapted to flex or spread outwardly to prevent the arrow from passing through the animal.

5. The trackable hunting arrow of claim 1, further comprising means for biasing the battery into electrical circuit relation with said battery.

6. The trackable hunting arrow of claim 5, wherein said means for biasing comprises a coil spring, wherein one end of the spring engages the battery and the other end engages a chamber closure.

7. The trackable hunting arrow of claim 1, wherein said transmitting apparatus is a microchip.

8. The trackable hunting arrow of claim 7, wherein said transmitting device is embodied in a transponder that transmits identifiable signals automatically when the proper interrogation is received from a transceiver remote thereto.

9. The trackable hunting arrow of claim 7, wherein said transmitting device is a radio transmitter-receiver device that transmits identifiable signals automatically when the proper interrogation is received from a transceiver remote thereto.

10. The trackable hunting arrow of claim 1, wherein said transmitter is a pulse repeater that receives pulses from the transceiver circuit and transmits corresponding pulses at another frequency, waveshape into the transceiver circuit.

11. A tracking system for detecting the location of an arrow or animal into which the arrow has been impaled relative to a positional satellite, the system comprising:

an arrow, said arrow including a shaft having forward and rearward ends, an arrowhead at the forward end, a nock housing at the rearward end of the shaft, the nock housing of electrically nonconductive material and having a chamber extending between the opposite ends of the housing, a transmitting apparatus assembled within the chamber, said transmitting apparatus including a receiver chip and provided with a code adapted to be read by said satellite wherein to transmit positional data regarding the real time latitude and longitude location of the location of the arrow, means for selectively removing and securing the nock housing to the rearward end of the arrow, and means for preventing the arrow from passing through the animal, said means for preventing being captivated to the rearward end portion of the shaft by the nock housing, and a transceiver responsive to positional data transmitted to the positional satellite from the transmitter, said receiver including a display screen for displaying information regarding the location of the receiver chip.

12. The tracking system of claim 11, wherein the means for preventing comprises a plurality of resilient impaling barbs extending longitudinally forward of the nock housing, the impaling barbs being spaced radially outwardly from the central axis of the shaft and adapted to flex or spread outwardly to prevent the arrow from passing through the animal.

13. A trackable hunting arrow, comprising an elongated shaft having forward and rearward ends, an arrowhead attached to said forward end, a nock housing of electrically nonconductive material, said nock housing having forward and rearward ends and an interior chamber opening on one end of the housing, a battery in said chamber, a radio transmitting apparatus in said chamber for transmitting a radio signal to a complementary receiver, said transmitter in electrical circuit relation with said battery, first means for closing the rearward end of said nock housing, second means for closing the forward end of said nock housing and removably attaching the nock housing to the rearward end of said shaft, said first and second means cooperating to captivate said battery and radio transmitting apparatus in said chamber, one said closing means enabling the user to selectively secure and remove the radio transmitter and battery into operable relation when ready for use, and an attachment device for impaling itself into the animal and attaching the arrow with battery and transmitter into said animal until located, the attachment device comprising a flat annular mounting plate captivated between the forward end of the nock housing and the rearward end of the arrow and at least one resilient impaling barb extending longitudinally forward of the housing, the impaling barb being spaced radially outwardly from the central axis of the shaft and adapted to flex or spread outwardly to prevent the arrow from passing through the animal.

* * * * *